US005765750A

United States Patent [19]

Pace et al.

[11] Patent Number: 5,765,750

[45] Date of Patent: Jun. 16, 1998

[54] METHOD AND APPARATUS FOR CONTROLLED ATOMIZATION IN A FUEL INJECTOR FOR AN INTERNAL COMBUSTION ENGINE

[75] Inventors: Jeffrey B. Pace, Newport News; Vernon R. Warner, Wicomico, both of Va.

[73] Assignee: Siemens Automotive Corporation, Auburn Hills, Mich.

[21] Appl. No.: 686,938

[22] Filed: Jul. 26, 1996

[51] Int. Cl.[6] ..... F02M 51/06; B05B 1/14

[52] U.S. Cl. ..... 239/5; 239/585.4; 239/590.3

[58] Field of Search ..... 239/585.3, 585.5, 239/590, 590.5, 553, 553.5, 596, 462, DIG. 23, 5; 251/129.21

[56] References Cited

U.S. PATENT DOCUMENTS

| | | | |
|---|---|---|---|
| 2,256,729 | 9/1941 | Thompson | 239/462 X |
| 2,778,684 | 1/1957 | Forst | 239/462 X |
| 4,625,919 | 12/1986 | Soma et al. | 239/585.4 |
| 4,628,576 | 12/1986 | Giachino et al. . | |
| 4,628,890 | 12/1986 | Freeman . | |
| 4,890,794 | 1/1990 | Imafuku et al. . | |
| 5,012,983 | 5/1991 | Buchholz et al. . | |
| 5,156,130 | 10/1992 | Soma . | |
| 5,207,383 | 5/1993 | Hans et al. . | |
| 5,220,900 | 6/1993 | Wakeman . | |
| 5,241,858 | 9/1993 | Wieczorek et al. . | |
| 5,242,119 | 9/1993 | Jariyasunant | 239/590.5 X |
| 5,344,081 | 9/1994 | Wakeman . | |
| 5,437,413 | 8/1995 | Shen et al. . | |
| 5,484,108 | 1/1996 | Nally | 239/585.4 X |

*Primary Examiner*—Lesley D. Morris
*Attorney, Agent, or Firm*—Russel C. Wells

[57] ABSTRACT

A flow straightener and a controlled disturbance element are interposed between the injector needle seat and the discharge orifice disk of a fuel injector. The flow straightener straightens flow eliminating turbulence prior to fuel discharge. The controlled disturbance disturbs the fuel flow providing controlled atomization. A spacer is provided between the flow straightener and the controlled disturbance element as well as between the controlled disturbance element and the discharge orifice disk delimiting flow recovery regions. By varying the diameter and/or height of the spacers, in conjunction with the controlled disturbance element, an adjustable level of flow disturbance can be obtained, leading to variable degrees of atomization. In one arrangement, the flow straightener and the controlled disturbance element are combined into a single flow element performing the functions of both the flow straightener and the controlled disturbance element.

18 Claims, 3 Drawing Sheets

METHOD AND APPARATUS FOR CONTROLLED ATOMIZATION IN A FUEL INJECTOR FOR AN INTERNAL COMBUSTION ENGINE

BACKGROUND OF THE INVENTION

The present invention relates to fuel injector for internal combustion engines and, in particular, to a method and apparatus for providing controlled atomization in a fuel injector.

An electromagnetic fuel injector utilizes a solenoid assembly to supply an actuating force to a fuel metering valve. Typically, a plunger style armature supporting a fuel injector needle reciprocates between a closed position, where the needle is seated in a needle seat to prevent fuel from escaping through the discharge orifice, and an open position, where fuel is discharged through the discharge orifice.

The discharge orifice is typically capped with a discharge orifice disk that directs the fuel to one or more desired locations. Turbulence within the injector occurring above the orifice disk, such as around the needle seat, affects the efficiency and directionality of the resultant fuel spray. It has been disclosed in commonly owned copending U.S. application Ser. No. 08/493,151 filed Jun. 21, 1995, the disclosure of which is hereby incorporated by reference, to provide a flow straightener disposed in the fuel passageway between the needle seat the discharge orifice disk. The flow straightener straightens fuel flow to provide an improved flow pattern, thereby providing a more targeted fuel spray.

SUMMARY OF THE INVENTION

The present invention relates to an improvement of the above-noted flow straightener. In accordance with the present invention, controlled atomization can be achieved by the introduction of a controlled disturbance element between the flow straightener and the discharge orifice disk. In alternative configurations, the flow straightener and the controlled disturbance element can be configured as a single flow element to perform both flow straightening and controlled disturbance for controlled atomization.

In accordance with one aspect of the present invention, there is provided a fuel injection valve for an internal combustion engine. The fuel injection valve includes an armature assembly having an injector needle reciprocable between a closed position and an open position; a needle seat receiving the injector needle in the closed position; a discharge orifice disk disposed downstream of the needle seat, the discharge orifice disk directing fuel toward a desired location; and at least one flow element disposed in a fuel path between the needle seat and the discharge orifice disk. The flow element serves to remove flow disturbances and control atomization of the fuel.

The flow element preferably includes a flow straightener disposed in the fuel path downstream of the needle seat and a controlled disturbance element disposed in the fuel path downstream of the flow straightener. A first spacer may be disposed between the flow straightener and the controlled disturbance element, and a second spacer may be disposed between the controlled disturbance element and the discharge orifice disk. In this regard, two flow recovery regions are defined by the first and second spacers. The controlled disturbance element is preferably formed with a plurality of apertures of various shapes disposed in the fuel path.

The flow element may be a single flow element removing flow disturbances and controlling atomization of the fuel. In this regard, the single flow element may be dimpled into the needle seat.

In accordance with another aspect of the invention, there is provided a method of constructing a fuel injection valve for an internal combustion engine. The method includes (a) inserting at least one flow element in a fuel path between the needle seat and the discharge orifice disk, wherein the at least one flow element removes flow disturbances and controls atomization of the fuel.

In accordance with the method, step (a) may be practiced by inserting a flow straightener in the fuel path downstream of the needle seat and a controlled disturbance element in the fuel path downstream of the flow straightener. The method preferably further includes inserting a first spacer between the flow straightener and the controlled disturbance element and a second spacer between the controlled disturbance element and the discharge orifice disk. Varying a dimension of at least one of the first spacer and the second spacer serves to adjust a flow disturbance level. Moreover, the disturbance element includes an aperture pattern disposed in the fuel path. In this regard, the method further includes varying the aperture pattern of the controlled disturbance element to adjust a flow disturbance level.

Step (a) may be practiced by inserting a single flow element removing flow disturbances and controlling atomization of the fuel.

BRIEF DESCRIPTION OF THE DRAWINGS

These and other aspects and advantages of the present invention will be apparent from the following detailed description of preferred embodiments when read in conjunction with the accompanying drawings, in which.

DETAILED DESCRIPTION OF PREFERRED EMBODIMENTS

Figure 1:
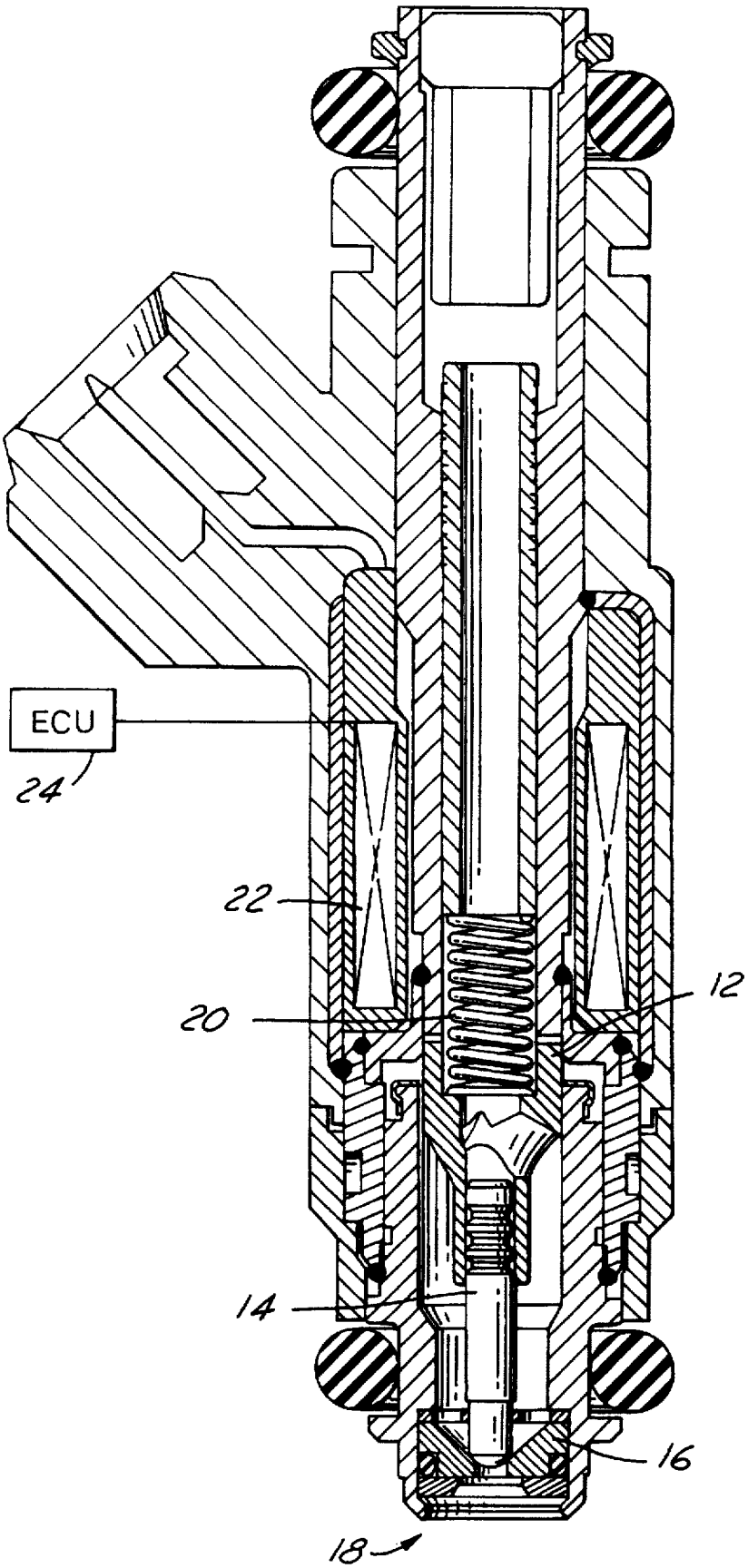
FIG. 1 is a cross-sectional view of an electromagnetic fuel injector.

A cross-sectional illustration of an exemplary fuel injector is illustrated in FIG. 1. The injector includes a reciprocating armature assembly 12 supporting an injector needle 14. The injector needle 14 is shaped to engage a needle seat 16 in a closed position adjacent a discharge orifice disk 18, which serves to direct the fuel to one or more desired locations. When engaged with the needle seat 16, fuel is prevented from being discharged through the orifice disk 18.

The armature assembly 12, and thus the injector needle 14, is reciprocal in the injector between a closed position (as shown in FIG. 1) and an open position. A spring 20 engages the armature assembly 12 and urges the assembly 12 toward the closed position. An electromagnetic coil 22 produces a magnetic field to draw the armature assembly 12, and the injector needle 14, against the force of the spring 20 to the injector needle open position. A driver circuit 24 of an ECU applies current to the electromagnetic coil 22.

When the injector needle 14 is in its open position, fuel in the injector rapidly flows across the needle seat 16 and through the discharge orifice disk 18, which directs the fuel toward the combustion chamber in the intake manifold (not shown). The needle seat 16 converges toward the discharge end of the injector as shown in, for example, FIGS. 1 and 2, which causes fuel turbulence prior to its discharge.

Figure 2:
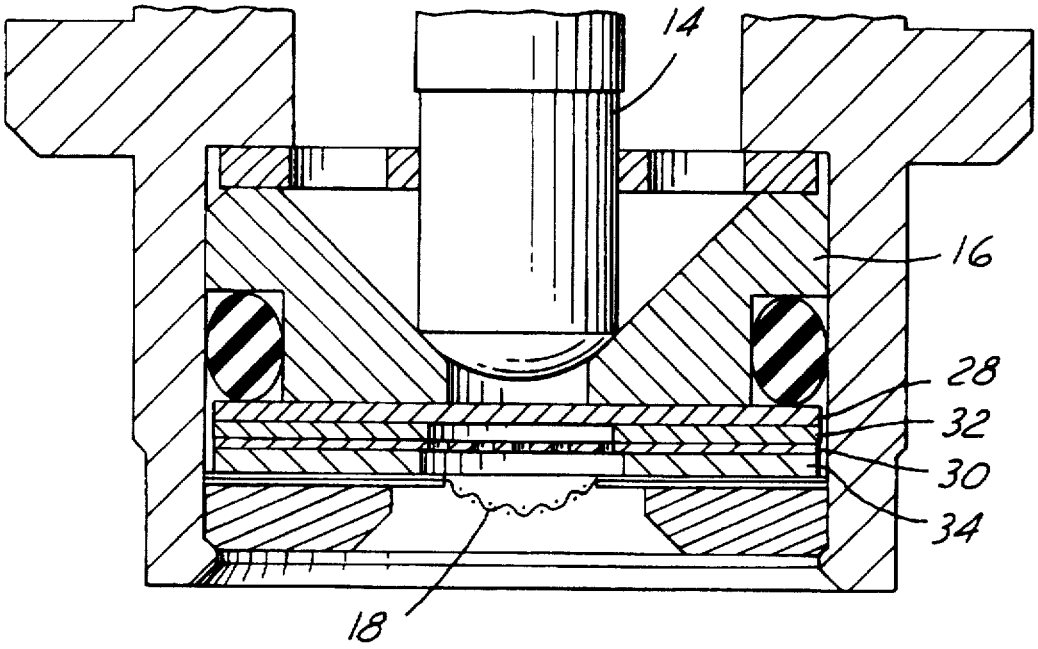
FIG. 2 is a cross-sectional view of a fuel injector including a flow straightener and a controlled disturbance element according to the present invention.

In accordance with the present invention, referring to FIG. 2, a flow straightener 28 is inserted in the fuel path downstream of the needle seat 16. The flow straightener 28, as disclosed in the above-noted copending application, serves to straighten the fuel flow providing an improved flow pattern. The flow straightener is preferably a porous material such as sintered metal, ceramic, porous plastic, screen or other mesh, and may be any suitable shape including, but not limited to, approximately flat, tubular, square, round or oval.

A controlled disturbance element 30 is inserted downstream of the flow straightener 28 between the flow straightener 28 and the discharge orifice disk 18. The controlled disturbance element 30 serves to disturb the flow in a controlled manner to provide for controlled atomization. The controlled disturbance element 30 is typically formed of sintered metal, ceramic, porous plastic, or appropriately sized screen or other mesh with an aperture pattern therethrough. Atomization is effected when the fuel strikes the controlled disturbance element aperture pattern, which breaks up the fuel into particles.

Figure 3A:
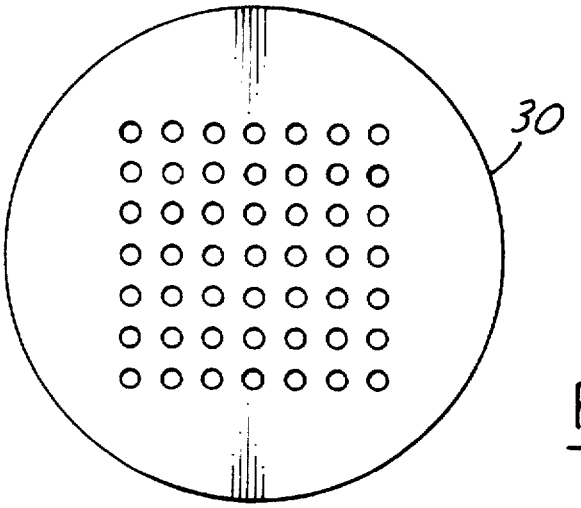
FIGS. 3A–3C are plan views of alternative controlled disturbance element configurations.
Figure 3B:
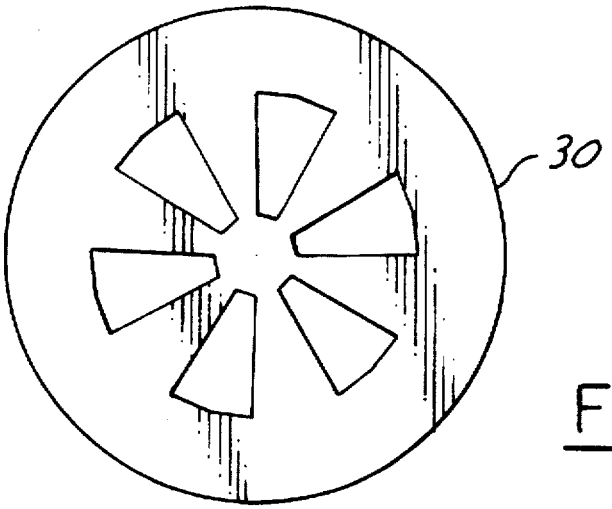
Figure 3C:
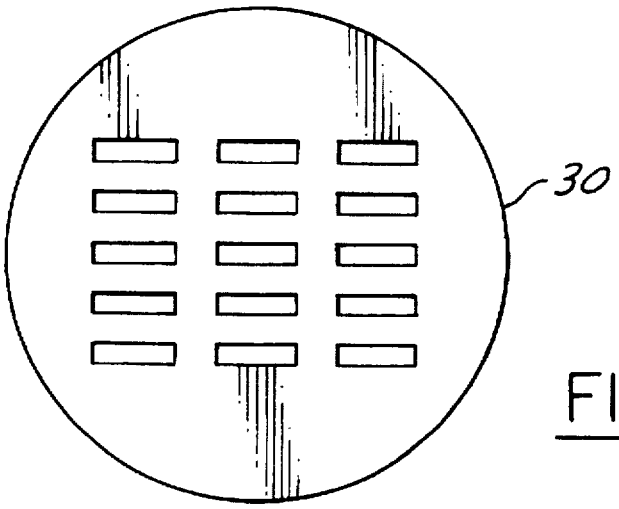

As shown in FIGS. 3A–C, the aperture pattern can be formed with several configurations including circular holes, wedges or slots. In some configurations, a center area of the controlled disturbance element 30 is blocked (as shown in FIG. 3B), to even fuel flow through the controlled disturbance element 30. By changing geometric features of the controlled disturbance element 30 such as the number of apertures in the aperture pattern versus the area of the apertures for different thicknesses, control over the flow disturbance level can be obtained. Of course, those of ordinary skill in the art may contemplate alternative configurations suitable for the controlled disturbance element 30, and the invention is not meant to be limited to the illustrated configurations.

A first spacer 32 is provided between the flow straightener 28 and the controlled disturbance element 30. The first spacer 32 delimits a recovery region for the fuel such that less porosity of the flow straightener is required to achieve flow straightness. In similar manner, a second spacer 34 is provided between the controlled disturbance element 30 and the discharge orifice disk 18, delimiting a second recovery region for the fuel. Varying the diameter and/or height of the first and second spacers 32, 34, in conjunction with the controlled disturbance element allows an adjustable level of flow disturbance to be obtained, leading to variable degrees of atomization. The spacers 32, 34 are preferably formed of the same materials as the flow straightener 28 and/or the controlled disturbance element 30, and the spacers 32, 34 along with the flow straightener 28 and the controlled disturbance element 30 are secured in the injector by being sandwiched between the needle seat 16 and the discharge orifice disk 18, which are attached in a conventional manner.

Figure 4:
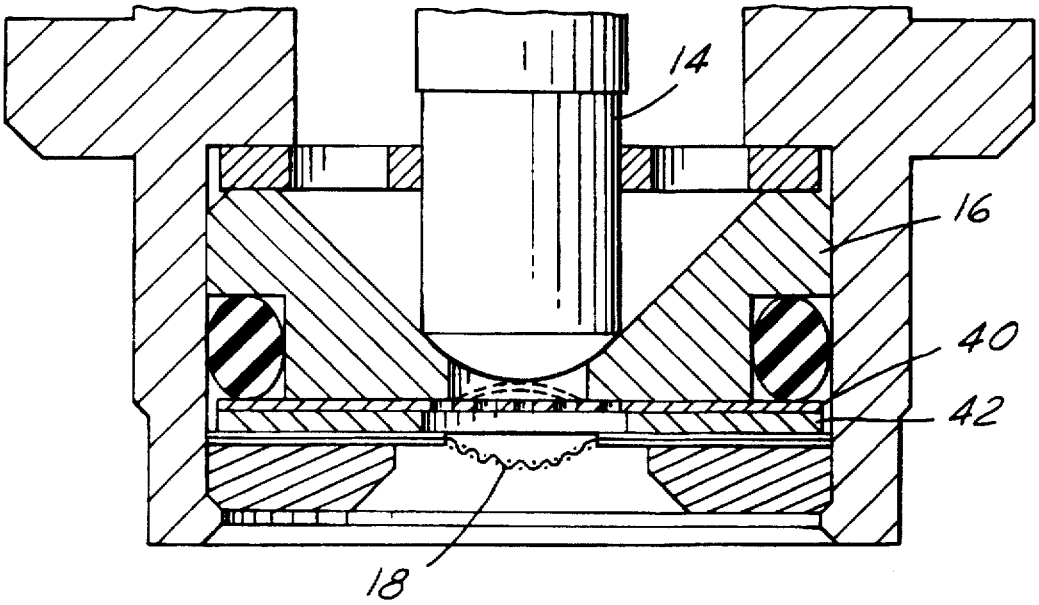
FIG. 4 is a cross-sectional view illustrating an alternative embodiment of the invention.

In an alternative embodiment, referring to FIG. 4, a flow element 40 is inserted between the needle seat 16 and the discharge orifice disk 18. The flow element is particularly configured such that fuel flow therethrough is subject to both flow straightening and controlled disturbance and thus controlled atomization. That is, the flow element 40 is configured with a prescribed porosity to effect both flow straightening and controlled atomization, performing the functions of both the flow straightener 28 and the controlled disturbance element 30 from the embodiment described above. A spacer 42 is provided to delimit a fuel recovery region.

In yet another alternative arrangement, the controlled disturbance element 30 or the flow element 40 can be dimpled upward into the needle seat 16 (as shown in dashed line in FIG. 4), advantageously reducing sac volume, thereby reducing an area for unwanted residual fuel.

In accordance with the present invention, turbulence at the discharge orifice can be eliminated and controlled atomization can be achieved to provide an improved flow pattern. The improved flow pattern results in better injection accuracy, emissions, driveability and other advantages.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A fuel injection valve for an internal combustion engine, comprising:

an armature assembly including an injector needle reciprocable between a closed position and an open position;

a needle seat receiving said injector needle in said closed position;

a discharge orifice disk disposed downstream of said needle seat, said discharge orifice disk directing fuel toward a desired location; and at least one flow element disposed in a fuel path between said needle seat and said discharge orifice disk, said at least one flow element removing flow disturbances and controlling atomization of the fuel.

2. A fuel injection valve according to claim 1, wherein said at least one flow element comprises a flow straightener disposed in said fuel path downstream of said needle seat for straightening fuel flow passing said needle seat and a controlled disturbance element disposed in said fuel path downstream of said flow straightener for disturbing the straightened flow to afford controlled atomization.

3. A fuel injection valve according to claim 2, further comprising a first spacer disposed between said flow straightener and said controlled disturbance element and a second spacer disposed between said controlled disturbance element and said discharge orifice disk.

4. A fuel injection valve according to claim 3, further comprising two flow recovery regions defined by said first and second spacers.

5. A fuel injection valve according to claim 2, wherein said controlled disturbance element comprises a plurality of apertures disposed in said fuel path.

6. A fuel injection valve according to claim 2, wherein said controlled disturbance element comprises a plurality of slotted apertures disposed in said fuel path.

7. A fuel injection valve according to claim 2, wherein said controlled disturbance element comprises a plurality of wedge apertures disposed in said fuel path.

8. A fuel injection valve according to claim 1, wherein said at least one flow element comprises a single flow element removing flow disturbances and controlling atomization of the fuel.

9. A fuel injection valve according to claim 8, wherein said single flow element is dimpled into said needle seat.

10. A method of constructing a fuel injection valve for an internal combustion engine, the fuel injection valve including an armature assembly including an injector needle reciprocable between a closed position and an open position, a needle seat receiving the injector needle in the closed position, and a discharge orifice disk disposed downstream of the needle seat, the method comprising (a) inserting at least one flow element in a fuel path between the needle seat and the discharge orifice disk, the at least one flow element removing flow disturbances and controlling atomization of the fuel.

11. A method according to claim 10, wherein step (a) is practiced by inserting a flow straightener in the fuel path downstream of the needle seat and a controlled disturbance element in the fuel path downstream of the flow straightener.

12. A method according to claim 11, further comprising inserting a first spacer between the flow straightener and the controlled disturbance element and a second spacer between the controlled disturbance element and the discharge orifice disk.

13. A method according to claim 12, further comprising varying a dimension of at least one of the first spacer and the second spacer to adjust a flow disturbance level.

14. A method according to claim 12, wherein the controlled disturbance element includes an aperture pattern disposed in the fuel path, the method further comprising varying the aperture pattern of the controlled disturbance element to adjust a flow disturbance level.

15. A method according to claim 10, wherein step (a) is practiced by inserting a single flow element removing flow disturbances and controlling atomization of the fuel.

16. A fuel injection valve for an internal combustion engine, comprising:

an armature assembly including an injector needle reciprocable between a closed position and an open position;

a needle seat receiving said injector needle in said closed position;

a discharge orifice disk disposed downstream of said needle seat, said discharge orifice disk directing fuel toward a desired location; and means disposed between said needle seat and said discharge orifice disk for removing flow disturbances and for controlling atomization of the fuel.

17. A fuel injection valve according to claim 16, wherein said removing and controlling means comprises a flow straightener disposed in said fuel path downstream of said needle seat and a controlled disturbance element disposed in said fuel path downstream of said flow straightener.

18. A fuel injection valve according to claim 16, wherein said removing and controlling means comprises a single flow element configured to remove flow disturbances and control atomization of the fuel.

* * * * *